US009914298B2

(12) United States Patent
Sakurai et al.

(10) Patent No.: US 9,914,298 B2
(45) Date of Patent: Mar. 13, 2018

(54) LIQUID EJECTION HEAD

(71) Applicant: CANON KABUSHIKI KAISHA, Tokyo (JP)

(72) Inventors: Makoto Sakurai, Kawasaki (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/063,933

(22) Filed: Mar. 8, 2016

(65) Prior Publication Data

US 2016/0297194 A1 Oct. 13, 2016

(30) Foreign Application Priority Data

Apr. 8, 2015 (JP) ..... 2015-079168

(51) Int. Cl.
*B41J 2/14* (2006.01)
*B41J 2/16* (2006.01)

(52) U.S. Cl.
CPC ..... *B41J 2/1404* (2013.01); *B41J 2/14072* (2013.01); *B41J 2/14129* (2013.01); *B41J 2/1603* (2013.01); *B41J 2/1628* (2013.01); *B41J 2/1631* (2013.01); *B41J 2/1642* (2013.01); *B41J 2/1646* (2013.01)

(58) Field of Classification Search
CPC ..... B41J 2/14; B41J 2/14032; B41J 2/1404; B41J 2/14072; B41J 2/14129; B41J 2002/14491; B41J 2202/08; B41J 2202/18
See application file for complete search history.

(56) References Cited

U.S. PATENT DOCUMENTS 6,382,775 B1 * 5/2002 Kubota ..... B41J 2/14129 347/62
6,474,769 B1 * 11/2002 Imanaka ..... B41J 2/04541 347/19
7,980,656 B2 7/2011 Sakurai et al.
8,141,987 B2 3/2012 Hayakawa et al.
2002/0126182 A1 9/2002 Miyamoto
2004/0160485 A1 * 8/2004 Imanaka ..... B41J 2/14072 347/58
2005/0006722 A1 * 1/2005 Zonca ..... H01L 45/06 257/536
2010/0285617 A1 * 11/2010 Saito ..... B41J 2/14129 438/21
2014/0184705 A1 * 7/2014 Wakamatsu ..... B41J 2/1606 347/68

FOREIGN PATENT DOCUMENTS

JP 2002-144571 A 5/2002

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A liquid ejection head comprises a semiconductor substrate having an energy generating element arranged thereon to generate energy to be utilized to eject liquid and a laminate including a plurality of insulating layers laid sequentially in the depth direction of the semiconductor substrate. Wiring is formed in the laminate and electrically connected to the energy generating element. The wiring includes a via formed in the insulating layers in the thickness direction of the insulating layers. The energy generating element is arranged between the semiconductor substrate and the laminate in the laminating direction of the insulating layers.

20 Claims, 4 Drawing Sheets

LIQUID EJECTION HEAD

BACKGROUND OF THE INVENTION

Field of the Invention

The present invention relates to a liquid ejection head for ejecting liquid by thermal energy.

Description of the Related Art

Known liquid ejection heads for ejecting liquid such as ink from the ejection ports thereof include a type of liquid ejection head designed to eject liquid by means of thermal energy. Liquid ejection heads of this type comprise energy generating elements that generate thermal energy according to the electric signals applied to them. They produce air bubbles in the liquid contained therein by means of the generated thermal energy and eject liquid by utilizing the air bubbles.

For liquid ejection heads of this type to stably perform liquid ejecting operations, the energy generating elements they have are required to sufficiently generate heat. On the other hand, they are required to suppress the electric current (the power consumption rate) for driving the energy generating elements for the purpose of energy saving. For example, Japanese Patent Application Laid-Open No. 2002-144571 describes an arrangement for improving the energy efficiency of an energy generating element to suppress its power consumption rate by increasing the current capacity of the wiring connected to the energy generating element. FIG. 6 of the accompanying drawings is a schematic cross-sectional view of a liquid ejection head having such an arrangement.

Referring to FIG. 6, an n-type impurity region 102 is formed in a semiconductor substrate 101, which is made of silicon, and a transistor 120 is formed on the n-type impurity region 102. A first heat accumulation layer 104 and a second heat accumulation layer 105 are sequentially formed in the above-mentioned order on a region of the semiconductor substrate 101 other than the region where the transistor 120 is formed. Additionally, first, second and third layer insulating films 106, 107*a* and 107*b* are sequentially formed in the above-mentioned order on the second heat accumulation layer 105 and a heater layer 109, which is to be used to operate as energy generating element 150, is formed thereon. A protection layer 115 is formed on the third layer insulating film 107*b* so as to cover the energy generating element 150. A dry film 114 and an orifice plate 113 are sequentially formed on the protection layer 115 in the above-mentioned order. A bubbling chamber 160 and a flow path (not illustrated) are formed in the dry film 114 at a position that corresponds to the energy generating element 150, while an ejection port 112 is formed in the orifice plate 113 so as to communicate with the bubbling chamber 160.

A first wiring layer 108*a*, a first via 110*a*, a second wiring layer 108*b*, a second via 110*b*, a third wiring layer 108*c* and a third via 110*c* are formed in the layer insulating films 106, 107*a* and 107*b* and electrically connected to each other. The energy generating element 150 is electrically connected to the transistor 120, which operates as a drive element, by way of these wiring layers 108*a* through 108*c* and vias 110*a* through 110*c*. More specifically, the energy generating element 150 is connected to the third via 110*c* while the first wiring layer 108*a* is connected to the p-type impurity region 103, which is the source/drain region of the transistor 120, by way of a fourth via 110*d* that is formed in the second heat accumulation layer 105. Additionally, an electrode 130 is also electrically connected to the transistor 120 by way of the wiring layers 108*a* and 108*b* and the vias 110*a* and 110*b*.

Thus, in the liquid ejection head 140 illustrated in FIG. 6, the wiring that is connected to the energy generating element 150 includes the vias 110*a* through 110*c* that are respectively formed in the layer insulating films 106, 107*a* and 107*b*. With this arrangement, a large current capacity is secured for the wiring that is connected to the energy generating element 150 and the energy generating element 150 represents improved energy efficiency.

SUMMARY OF THE INVENTION

The present invention provides a liquid ejection head including: a semiconductor substrate having an energy generating element arranged thereon to generate energy to be utilized to eject liquid; and a laminate including a plurality of insulating layers laid sequentially in the depth direction of the semiconductor substrate and having wiring formed therein and electrically connected to the energy generating element, the wiring including a via formed in the insulating layers; the energy generating element being arranged between the semiconductor substrate and the laminate in the laminating direction of the insulating layers.

With the above-described arrangement, the present invention can provide a liquid ejection head representing high energy efficiency and is highly reliable in terms of capability of stably performing liquid ejecting operations.

Further features of the present invention will become apparent from the following description of exemplary embodiments with reference to the attached drawings.

DESCRIPTION OF THE EMBODIMENTS

Figure 6:
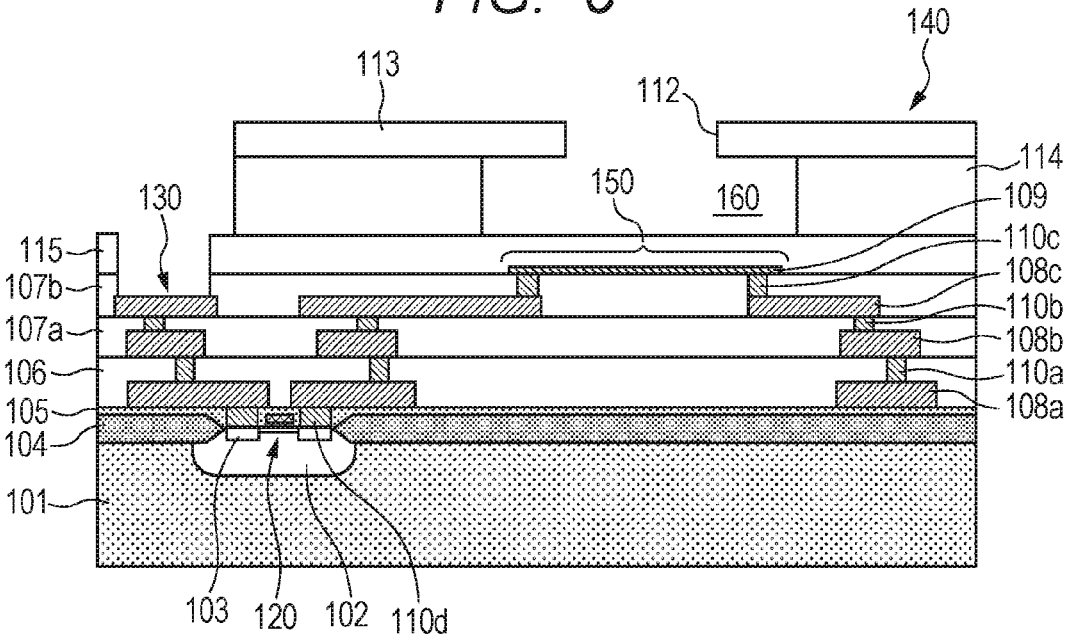
FIG. 6 is a schematic cross-sectional view of a known liquid ejection head.

A planarization technique involving chemical mechanical polishing (CMP) is employed to form the layer insulating films 106, 107*a* and 107*b* in the process of manufacturing a liquid ejection head 140 as illustrated in FIG. 6. The accuracy of the thicknesses of the layer insulating films 106, 107*a* and 107*b* formed by way of a CMP process is largely influenced by the width and density of the wiring in the layout in addition to the manufacturing process conditions including the polishing time and the polishing pressure. In other words, the CMP process can give rise to variations in the film thicknesses of the layer insulating films 106, 107*a* and 107*b* to a large extent due to the problem of processing accuracy it involves.

Meanwhile, the layer insulating films 106, 107*a* and 107*b* also function as heat accumulation layers for accumulating the heat generated by the energy generating element 150. Therefore, when the film thicknesses of the layer insulating films 106, 107*a* and 107*b* represent variations to a large extent, it may be necessary to put energy into the energy generating element 150, taking the variations into consideration, in order to make the liquid ejection head stably perform liquid ejecting operations. This means that energy may excessively be put into the energy generating element 150 to in turn reduce the energy efficiency. Then, such an excessive energy input can consequently damage the reliability of the energy generating element 150 because the wiring extending from the element 150 can be broken by the excessive energy.

On the other hand, a liquid ejection head according to the present invention comprises a semiconductor substrate on which an energy generating element for generating energy to be utilized to eject liquid is arranged and a laminate that includes a plurality of insulating layers sequentially laid in the depth direction of the semiconductor substrate and wiring electrically connected to the energy generating element. The wiring includes a via formed in the insulating layers. The energy generating element is arranged between the semiconductor substrate and the laminate in the laminating direction of the insulating layers.

With the above-described arrangement, the present invention provides a liquid ejection head representing high energy efficiency and having a capability of stably performing liquid ejecting operations.

Now, the present invention will be described in greater detail by referring to the accompanying drawings that schematically illustrate currently preferable embodiments of the present invention.

First Embodiment

Figure 1:
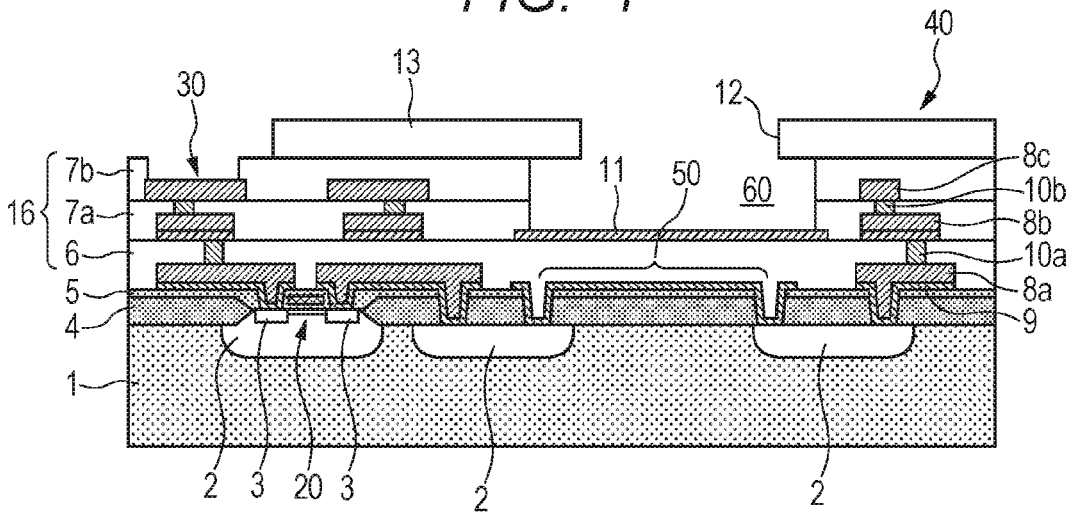
FIG. 1 is a schematic cross-sectional view of the first embodiment of liquid ejection head according to the present invention.

FIG. 1 is a schematic cross-sectional view of the first embodiment of liquid ejection head according to the present invention.

Referring to FIG. 1, the liquid ejection head 40 of this embodiment comprises a semiconductor substrate 1 on which an energy generating element 50 for generating energy to be utilized to eject liquid is arranged and an ejection port forming member 13 in which an ejection port 12 for ejecting liquid is formed. The liquid ejection head 40 also comprises a laminate 16 arranged between the semiconductor substrate 1 and the ejection port forming member 13 and formed by using a plurality of insulating layers (layer insulating films) 6, 7*a* and 7*b* that are sequentially laid one on the other on the surface of the semiconductor substrate 1 where the energy generating element 50 is also arranged.

A plurality of n-type impurity regions 2 are formed in the semiconductor substrate 1 that is made of silicon and a transistor 20, which is a drive element for driving the energy generating element 50, is formed on one of the n-type impurity regions 2. A first heat accumulation layer 4 and a second heat accumulation layer 5 are sequentially formed in the above-mentioned order on the surface region of the semiconductor substrate 1 where the transistor 20 is not formed. The energy generating element 50 is formed on the semiconductor substrate 1 by way of the first heat accumulation layer 4 and the second heat accumulation layer 5. The first heat accumulation layer 4 and the second heat accumulation layer 5 have a function of accumulating the heat generated by the energy generating element 50 to reduce the time necessary for raising the temperature of the energy generating element 50 to a predetermined level and improve the thermal responsiveness of the liquid ejection head 40.

The first layer insulating film 6 is formed on the first heat accumulation layer 4 and the second heat accumulation layer 5 by way of a heater layer 9. The heater layer 9 is formed between the second heat accumulation layer 5 and the first layer insulating film 6 so as to represent a predetermined pattern. Additionally, the heater layer 9 is arranged so as to run through the first heat accumulation layer 4 and the second heat accumulation layer 5 and connect itself to the n-type impurity regions 2 and also to p-type impurity regions 3, which operate as the source/drain region of the transistor 20. The part of the heater layer 9 that is connected to two different n-type impurity regions 2 at the opposite ends thereof is employed as the energy generating element 50. Another part of the heater layer 9 is connected at one of the opposite ends thereof to one of the n-type impurity regions 2 that are connected to the energy generating element 50 and at the other end thereof to one of the p-type impurity regions 3. With this arrangement, the electric connection between the energy generating element 50 and the transistor 20 is secured.

A first wiring layer 8*a* and a first via 10*a* are buried in the first layer insulating film 6. The first wiring layer 8*a* is formed on the heater layer 9 and the first via 10*a* is formed on the first wiring layer 8*a*. Note that the first wiring layer 8*a* is not formed in the part of the heater layer 9 that operates as the energy generating element 50.

The second layer insulating film 7*a* and the third layer insulating film 7*b* are sequentially formed on the first layer insulating film 6. A bubbling chamber 60 that communicates with the ejection port 12 and a flow path (not illustrated) that communicates with the bubbling chamber 60 so as to supply the ejection port 12 with liquid by way of the bubbling chamber 60 are formed in the second layer insulating film 7*a* and the third layer insulating film 7*b*.

A layer that is formed simultaneously with an anti-cavitation layer 11, a second wiring layer 8*b* and a second via 10*b* are buried in the second layer insulating film 7*a*. The anti-cavitation layer 11 and the layer that is formed simultaneously with it are formed on the first layer insulating film 6 to represent a predetermined pattern. The anti-cavitation layer 11 is arranged between the bubbling chamber 60 and the energy generating element 50 and has a function of protecting the energy generating element 50 from damages due to cavitation that occurs when air bubbles are produced in the bubbling chamber 60 and also when they disappear and other phenomena. The second wiring layer 8*b* is formed on the layer that is formed simultaneously with the anti-cavitation layer 11 in the same process and electrically connected to the first wiring layer 8*a* by way of this layer and the first via 10*a*. On the other hand, the second via 10*b* is formed on the second wiring layer 8*b*.

The third wiring layer 8*c* is buried in the third layer insulating film 7*b*. The third wiring layer 8*c* is formed to represent a predetermined pattern that allows it to connect itself to the second via 10*b*. Then, as a result, the third wiring layer 8*c* is electrically connected to the second wiring layer 8*b* by way of the second via 10*b*. The part of the third wiring layer 8*c* on which the third layer insulating film 7*b* is not arranged and hence which is exposed to the outside is employed as electrode 30. The electrode 30 is connected to the transistor 20 by way of the first, second and third wiring layers 8*a* through 8*c* and the first and second vias 10*a* and 10*b* and thereby electrically connected to the energy generating element 50. The ejection port forming member 13 where the ejection port 12 is formed is arranged on the third layer insulating film 7*b*. The ejection port 12 communicates with the bubbling chamber 60 and is arranged at a position located vis-à-vis the energy generating element 50.

With the above-described arrangement of this embodiment, the energy generating element 50 is located between the semiconductor substrate 1 and the layer insulating films 6, 7*a* and 7*b* as viewed in the laminating direction of the layer insulating films 6, 7*a* and 7*b* that are laid one on the other in the depth direction of the semiconductor substrate 1. Differently stated, the plurality of layer insulating films 6, 7*a* and 7*b* whose film thicknesses can vary to a large extent are not found between the semiconductor substrate 1 and the energy generating element 50. With such an arrangement, one or more than one thermally oxidized films such as silicon films whose film thicknesses, if any, will represent only small variations can be formed as heat accumulation layers. Then, as a result, the energy generating element 50 can be driven with an optimum rate of energy application to make the liquid ejection head an energy saving device and allow the liquid ejection head to stably operate for liquid ejection. Additionally, the wiring connected to the energy generating element 50 is made to include the vias 10*a* and 10*b* that are formed in the layer insulating films 6, 7*a* and 7*b*. Thus, a sufficient current capacity is secured for the wiring to in turn improve the energy efficiency.

Now, the method of manufacturing the liquid ejection head of this embodiment will specifically be described below by referring to FIGS. 2A, 2B, 3A through 3D and 4A through 4C. FIGS. 2A, 2B, 3A through 3D and 4A through 4C are schematic cross-sectional views of the liquid ejection head of this embodiment in different steps of the manufacturing method.

Figure 2A:
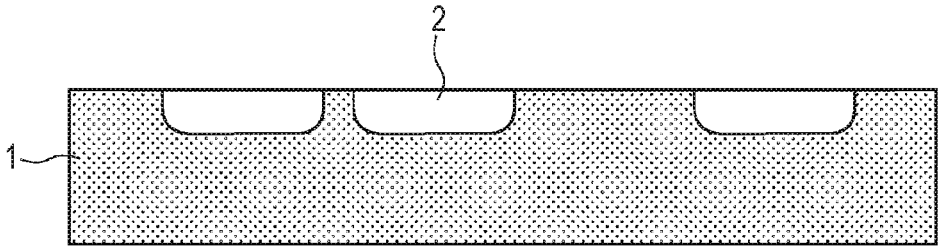
FIGS. 2A and 2B are schematic cross-sectional views illustrating steps of the method of manufacturing the first embodiment of liquid ejection head of the present invention.

First, a silicon substrate is brought in as semiconductor substrate 1. Then, after washing the semiconductor substrate 1, a lithography step and an ion injection step are executed to produce a plurality of n-type impurity regions 2 where silicon is doped with an n-type impurity as illustrated in FIG. 2A.

Figure 2B:
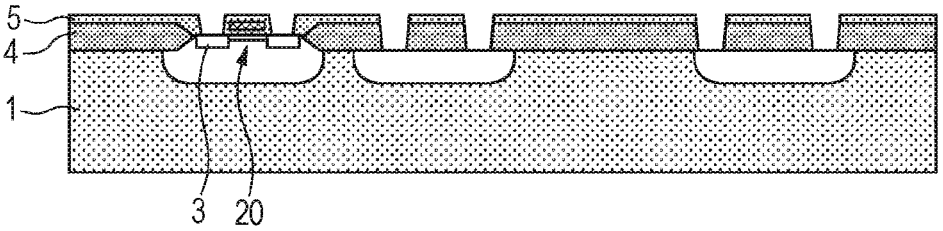

Then, as illustrated in FIG. 2B, a first heat accumulation layer 4, a second heat accumulation layer 5 and a transistor 20 are formed.

More specifically, to begin with, a silicon nitride film (not illustrated) is formed on the semiconductor substrate 1 and then the silicon nitride film is removed from the surface of the semiconductor substrate 1 except the region for forming a transistor 20. Next, a silicon oxide film is formed as first heat accumulation layer 4 in the surface region of the semiconductor substrate 1 where the silicon nitride film has been removed by thermally oxidizing the surface of the semiconductor substrate 1 in that region and subsequently, the remaining silicon nitride film is removed. Then, a gate is formed for a transistor 20 by using the silicon oxide film (insulating film) that has been produced by thermal oxidation and polysilicon (silicide if appropriate) and subsequently p-type impurity regions 3 (source/drain region) where silicon is doped with a p-type impurity are formed by way of an ion injection step. Thus, a transistor 20 is produced there. Then, either a BPSG (boron phosphorous silicon glass) film is formed by chemical vapor deposition or a P—SiO (SiO produced by plasma CVD) film is formed. Thereafter, a lithography step and an etching step are executed to realize a predetermined pattern out of the silicon oxide film and either the BPSG film or the P—SiO film in order to produce a first heat accumulation layer 4 and a second heat accumulation layer 5.

Figure 3A:
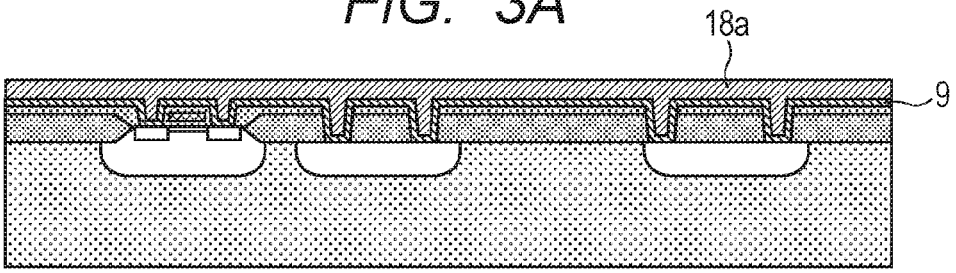
FIGS. 3A, 3B, 3C and 3D are schematic cross-sectional views also illustrating steps of the method of manufacturing the first embodiment of liquid ejection head of the present invention.

Then, as illustrated in FIG. 3A, a barrier layer (not illustrated), which may typically be made of a TiN film, and a heater layer 9, which may typically be made of a TiSiN film, are formed by sputtering and subsequently a first wiring layer forming film 18*a* is formed by using either an Al film or an Al alloy film.

Figure 3B:
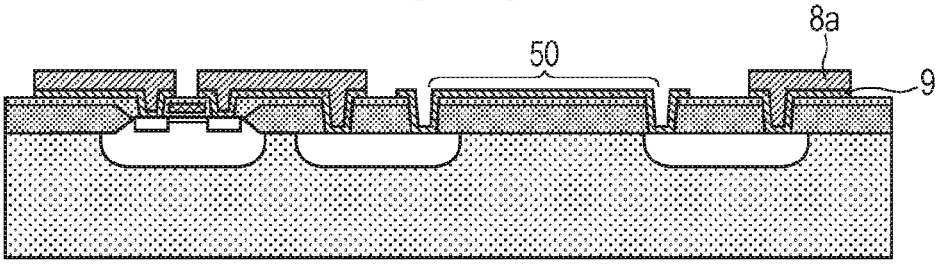

Then, a lithography step and an etching step are executed so as to produce a predetermined pattern out of the heater layer 9 and the first wiring layer forming film 18*a*. Thus, a first wiring layer 8*a* is produced as illustrated in FIG. 3B. Thereafter, a lithography step and an etching step are executed again so as to remove the part of the first wiring layer forming film 18*a* formed on the heater layer 9, which is to be used to produce an energy generating element 50.

Figure 3C:
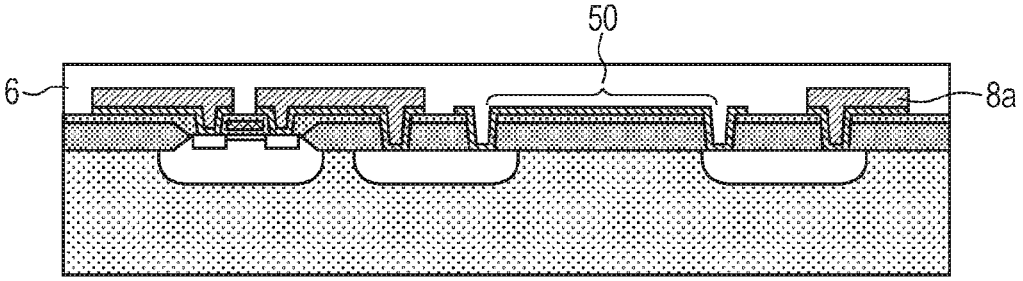

Subsequently, a first layer insulating film 6 is formed as illustrated in FIG. 3C. More specifically, a first layer insulating film 6 is formed by forming, for instance, an SiN film, an SiO film, an SiOC film or an SiCN film to a thickness of between 100 and 500 nm by CVD and then planarizing the surface of the film by chemical mechanical polishing (CMP).

Figure 3D:
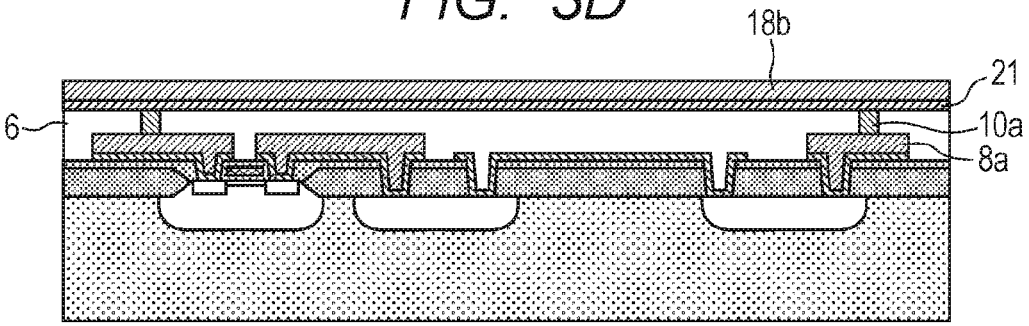

Then, a lithography step and an etching step are executed to remove part of the first layer insulating film 6. Then, typically a Ti film having a thickness of between 15 and 25 nm and a TiN film having a thickness of between 20 and 70 nm are successively formed by sputtering to produce a barrier layer (not illustrated). Furthermore, a tungsten film is formed by CVD. Thereafter, the barrier layer and the tungsten film are partly removed by dry etching or CMP to produce a first via 10*a* that is connected to the first wiring layer 8*a* as illustrated in FIG. 3D. Subsequently, an anti-cavitation layer forming film 21 and a second wiring layer forming film 18*b* are sequentially formed in the above-mentioned order on the first layer insulating film 6 by sputtering. More specifically, an anti-cavitation layer forming film 21 typically having a film thickness of between 20 and 300 nm and made of a Ta film, an Ir film or an Ru film and a second wiring layer forming film 18*b* typically having a film thickness of between 100 and 15,000 nm and made of an Al film or an Al alloy film are formed on the first layer insulating film 6.

Figure 4A:
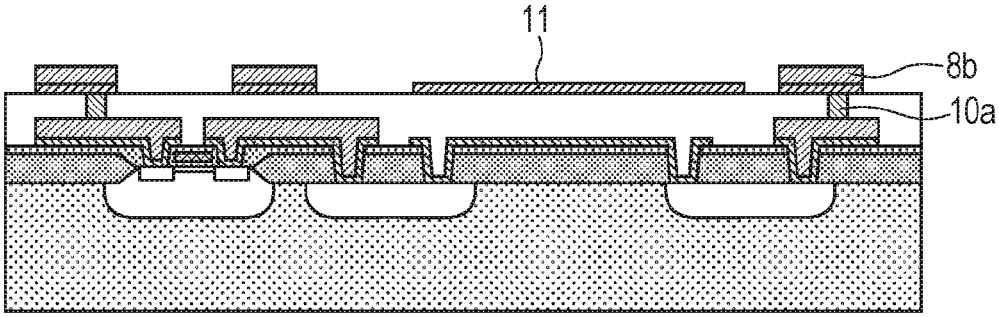
FIGS. 4A, 4B and 4C are schematic cross-sectional views also illustrating steps of the method of manufacturing the first embodiment of liquid ejection head of the present invention.

Then, a lithography step and an etching step are executed so as to produce a predetermined pattern out of the anti-cavitation layer forming film 21 and also the second wiring layer forming film 18*b* so that consequently a second wiring layer 8*b* that is connected to the first via 10*a* is formed as illustrated in FIG. 4A. Subsequently, a lithography step and an etching step are also executed so as to remove the second wiring layer forming film 18*b* that has been formed on the anti-cavitation layer forming film 21 from the part thereof that is to be used to produce an anti-cavitation layer 11.

Figure 4B:
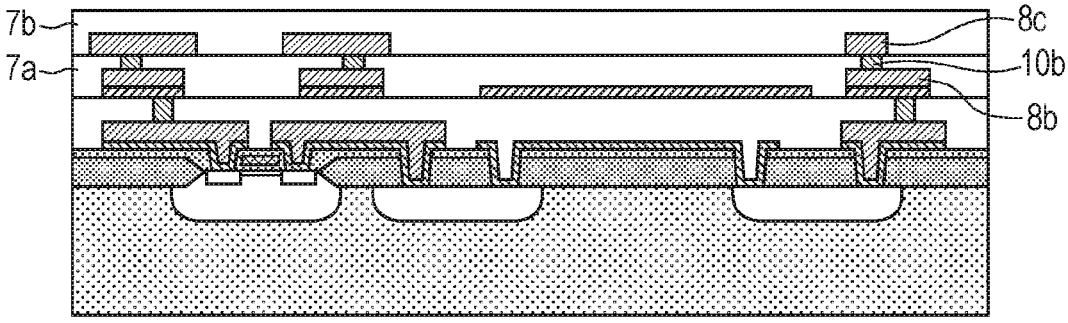

Then, as illustrated in FIG. 4B, a second layer insulating film 7*a*, a second via 10*b*, a third wiring layer 8*c* and a third layer insulating film 7*b* are formed.

More specifically, for instance, an SiO film, an SiOC film or an SiCN film is formed to begin with to a film thickness of between 500 and 5,000 nm by CVD and the surface thereof is planarized by CMP to produce a second layer insulating film 7*a*.

Subsequently, a lithography step and an etching step are executed so as to remove part of the second layer insulating film 7*a*. Then, a Ti film having a thickness of, for example, between 15 and 25 nm and a TiN film having a thickness of, for example, between 20 and 70 nm are successively formed by sputtering to produce a barrier layer (not illustrated). Furthermore, a tungsten film is formed by CVD. Thereafter, the barrier layer and the tungsten film are partly removed by means of dry etching or CMP to produce a second via 10*b* that is connected to the second wiring layer 8*b*.

Immediately thereafter, a barrier layer (not illustrated) made of a Ti film and a TiN film and having a thickness of, for example, between 20 and 60 nm is formed and then an Al film or an Al alloy film having a thickness of, for example, between 100 and 15,000 nm is formed as third wiring layer 8*c* by sputtering. Then, a lithography step and an etching step are executed so as to make the Al film or the Al alloy film, and the barrier layer represent a predetermined pattern and produce a third wiring layer 8*c* that is connected to the second via 10*b*.

Furthermore, for example, an SiO film, an SiOC film or an SiCN film is formed to a thickness of, for example, between 500 and 5,000 nm, by CVD and a third layer insulating film 7*b* is produced by planarizing the surface thereof by CMP.

Figure 4C:
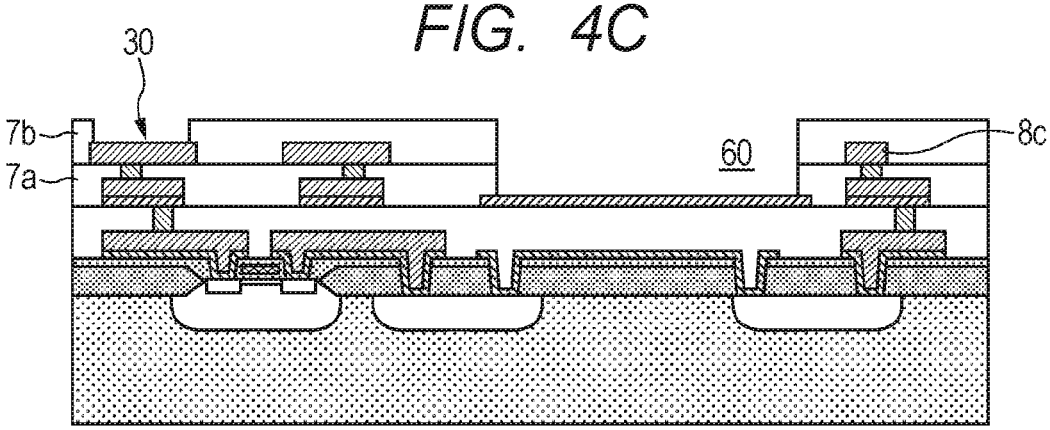

Then, a lithography step and an etching step are executed so as to partly remove the second and third layer insulating films 7*a* and 7*b* and produce a bubbling chamber 60 as illustrated in FIG. 4C. Additionally, the third layer insulating film 7*b* is partly removed so as to partly expose the third wiring layer 8*c* and make the exposed part to operate as electrode 30.

Finally, an ejection port forming member 13 is formed by using a dry film of epoxy-based resin or the like, which is produced by lamination, and an ejection port 12 is formed therein to provide a complete liquid ejection head 40 as illustrated in FIG. 1.

Thus, no CMP is employed to produce the first and second heat accumulation layers 4 and 5 in the liquid ejection head 40 that is manufactured in the above-described manner. Thus, if compared with the use of CMP for producing the first and second heat accumulation layers 4 and 5, the variations of film thickness of these heat accumulation layers 4 and 5 ((the extent of variation/average value)×(½)×100) can be reduced to about somewhere between ½ and ⅙. Then, as a result, any excessive energy input can be avoided to manufacture a liquid ejection head that stably operates for liquid ejection in an energy saving manner.

Second Embodiment

Figure 5:
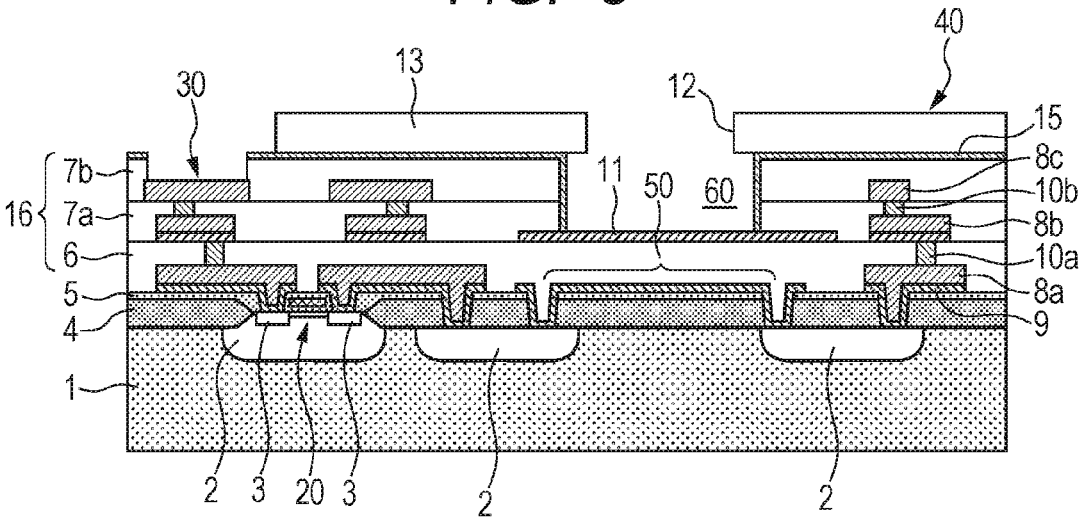
FIG. 5 is a schematic cross-sectional view of the second embodiment of liquid ejection head according to the present invention.

FIG. 5 is a schematic cross-sectional view of the second embodiment of liquid ejection head according to the present invention.

A protection film 15, which is a TiO film, a TaO film or an SiOC film, is formed to cover the inner walls of the bubbling chamber 60 and the flow path (not illustrated) of the liquid ejection head 40 of this embodiment. With this arrangement, when the liquid ejection head 40 ejects liquid such as ink, the resistance against ink of the bubbling chamber 60 is improved to in turn improve the shape stability of the bubbling chamber 60. Then, as a result, the liquid ejection head 40 can accurately and stably operate for liquid ejection.

When manufacturing the liquid ejection head 40 of this embodiment, the steps down to the steps illustrated in FIG. 4C were executed as in the instance of the first embodiment and then a protection film 15 is formed to a thickness of, for example, between 5 and 100 nm by CVD or atomic layer deposition (ALD). Thereafter, an ejection port forming member 13 is formed by deposition as in the case of the first embodiment, to produce a complete liquid ejection head 40 as illustrated in FIG. 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-079168, filed Apr. 8, 2015, which is hereby incorporated by reference herein in its entirety.

What is claimed is:

1. A liquid ejection head comprising:

a semiconductor substrate having an energy generating element arranged thereon to generate energy to be utilized to eject liquid;

an ejection port forming member having an ejection port for ejecting liquid; and a laminate including a plurality of insulating layers laid sequentially in the depth direction of the semiconductor substrate and having wiring formed therein and electrically connected to the energy generating element, the wiring including a via formed in the insulating layers, wherein the energy generating element is arranged between the semiconductor substrate and the laminate in the laminating direction of the insulating layers, and the ejection port is arranged at a position opposed to the energy generating element.

2. The liquid ejection head according to claim 1, wherein the wiring includes a plurality of wiring layers that are respectively buried in the insulating layers and electrically connected to each other by the via.

3. The liquid ejection head according to claim 1, wherein the wiring is electrically connected to the energy generating element by way of impurity regions formed in the semiconductor substrate.

4. The liquid ejection head according to claim 1, wherein a heat accumulation layer is formed between the semiconductor substrate and the energy generating element to accumulate heat generated by the energy generating element.

5. The liquid ejection head according to claim 4, wherein the semiconductor substrate is made of silicon and the heat accumulation layer includes a thermally oxidized film of the silicon.

6. The liquid ejection head according to claim 1, wherein the laminate includes a bubbling chamber communicating with the ejection port and a flow path communicating with the bubbling chamber.

7. The liquid ejection head according to claim 6, wherein the laminate includes a protection film covering the inner walls of the bubbling chamber and the flow path.

8. The liquid ejection head according to claim 7, wherein the protection film is made of a TiO film, a TaO film or an SiOC film.

9. The liquid ejection head according to claim 1, wherein the energy generating element is a part of a heater layer that is connected to two different n-type impurity regions at the opposite ends thereof.

10. The liquid ejection head according to claim 1, wherein the energy generating element is made of a TiSiN film.

11. A liquid ejection head comprising:

a semiconductor substrate having an energy generating element arranged thereon to generate energy to be utilized to eject liquid;

an ejection port forming member having an ejection port for ejecting liquid, the ejection port being arranged opposed to the surface of the energy generating element; and a laminate arranged between the energy generating element of the semiconductor substrate and the ejection port forming member and having wiring formed therein and electrically connected to the energy generating element, the laminate including a plurality of insulating layers laid sequentially in the depth direction of the semiconductor substrate, the wiring including a via formed in the insulating layers.

12. The liquid ejection head according to claim 11, wherein the wiring includes a plurality of wiring layers that are respectively buried in the insulating layers and electrically connected to each other by the via.

13. The liquid ejection head according to claim 11, wherein the wiring is electrically connected to the energy generating element by way of impurity regions formed in the semiconductor substrate.

14. The liquid ejection head according to claim 11, wherein a heat accumulation layer is formed between the semiconductor substrate and the energy generating element to accumulate heat generated by the energy generating element.

15. The liquid ejection head according to claim 14, wherein the semiconductor substrate is made of silicon and the heat accumulation layer includes a thermally oxidized film of the silicon.

16. The liquid ejection head according to claim 11, wherein the laminate includes a bubbling chamber communicating with the ejection port and a flow path communicating with the bubbling chamber.

17. The liquid ejection head according to claim 16, wherein the laminate includes a protection film covering the inner walls of the bubbling chamber and the flow path.

18. The liquid ejection head according to claim 17, wherein the protection film is made of a TiO film, a TaO film or an SiOC film.

19. The liquid ejection head according to claim 11, wherein the energy generating element is a part of a heater layer that is connected to two different n-type impurity regions at the opposite ends thereof.

20. The liquid ejection head according to claim 11, wherein the energy generating element is made of a TiSiN film.

* * * * *